US010681998B2

(12) United States Patent
Alletto, Jr.

(10) Patent No.: US 10,681,998 B2
(45) Date of Patent: Jun. 16, 2020

(54) PILLOW WITH GUSSET AND OPEN CELL CONSTRUCTION

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 34 days.

(21) Appl. No.: 15/362,265

(22) Filed: Nov. 28, 2016

(65) Prior Publication Data

US 2017/0071373 A1 Mar. 16, 2017

Related U.S. Application Data

(63) Continuation of application No. 14/698,441, filed on Apr. 28, 2015, which is a continuation of application
(Continued)

(51) Int. Cl.
*A47C 20/00* (2006.01)
*A47G 9/10* (2006.01)
(Continued)

(52) U.S. Cl.
CPC ..... *A47G 9/1036* (2013.01); *A47G 9/10* (2013.01); *A47G 9/1054* (2013.01); *A47C 20/02* (2013.01);
(Continued)

(58) Field of Classification Search
CPC ..... A47G 9/1036; A47G 9/1054; A47G 2009/1018; A47G 9/10; A47G 9/0253;
(Continued)

(56) References Cited

U.S. PATENT DOCUMENTS 1,212,515 A 1/1917 Leavitt
1,876,591 A 9/1932 Bawden
(Continued)

FOREIGN PATENT DOCUMENTS

EP 1222886 A2 7/2002
EP 1378193 A1 1/2004
(Continued)

OTHER PUBLICATIONS

International Search Report and Written Opinion of the International Search Authority dated Apr. 6, 2010 in International Application No. PCT/US2009/069018 (WO2010075294), Applicants: Tempur-Pedic Management, Inc.
(Continued)

*Primary Examiner* — Nicholas F Polito
*Assistant Examiner* — Morgan J McClure
(74) *Attorney, Agent, or Firm* — Sorell, Lenna & Schmidt, LLP

(57) ABSTRACT

A pillow is provided herein which includes a cover having opposing first and second panels. A gusset perimetrically bounds, and joins, the first and second panels. The gusset is formed of an open cell construction. Compliant fill material is disposed within the cover. Advantageously, with the subject invention, a pillow is provided allowing for lateral ventilation between opposing panels. This permits a cooling effect while a user is resting or sleeping.

20 Claims, 4 Drawing Sheets

Related U.S. Application Data

No. 14/328,008, filed on Jul. 10, 2014, now Pat. No. 9,015,883, which is a continuation of application No. 14/107,665, filed on Dec. 16, 2013, now Pat. No. 8,887,332, which is a continuation of application No. 13/531,122, filed on Jun. 22, 2012, now Pat. No. 8,646,134.

(60) Provisional application No. 61/499,907, filed on Jun. 22, 2011.

(51) Int. Cl.
*A47G 9/00* (2006.01)
*A47C 20/02* (2006.01)
*A47G 9/02* (2006.01)

(52) U.S. Cl.
CPC ..... *A47G 9/00* (2013.01); *A47G 9/0253* (2013.01); *A47G 2009/1018* (2013.01)

(58) Field of Classification Search
CPC ..... A47G 9/02; A47G 9/0207; A47G 9/0238; A47G 9/0246; A47G 9/0261; A47G 9/0292; A47G 9/00; A47C 20/02
USPC ..... 5/636
See application file for complete search history.

(56) References Cited

U.S. PATENT DOCUMENTS 2,128,978 A 9/1938 Akin
2,217,999 A * 10/1940 De Woskin ..... A47G 9/0253 5/484
2,566,790 A 9/1951 Bloomfield
2,639,444 A * 5/1953 De Monsabert ..... A47C 31/105 5/499
2,765,480 A 10/1956 Mueller
2,784,420 A 3/1957 Moltane
2,927,331 A 3/1960 Ruiz
3,103,669 A 9/1963 Mundis
3,109,182 A * 11/1963 Doak ..... A47C 27/22 5/636
3,183,527 A 5/1965 Turner
3,438,069 A 4/1969 Long
3,521,310 A 7/1970 Greenawalt
3,882,871 A 5/1975 Taniguchi
4,232,415 A 11/1980 Webber
4,280,342 A 7/1981 Eng et al.
4,292,703 A * 10/1981 Goguen ..... A47C 21/046 29/91.2
4,370,765 A 2/1983 Webber
4,445,241 A * 5/1984 Ender ..... A47C 27/006 5/490
4,631,765 A * 12/1986 Casey ..... A47G 9/0207 428/33
4,644,591 A 2/1987 Goldberg
4,665,575 A * 5/1987 Raught ..... A47C 21/046 441/128
4,767,419 A 8/1988 Fattore
4,903,357 A 2/1990 Kruchen et al.
4,914,772 A * 4/1990 Difloe ..... A47C 7/66 297/452.43
4,922,565 A 5/1990 Blake
5,010,611 A 4/1991 Mallett
5,086,530 A 2/1992 Blake
5,148,564 A 9/1992 Reder
5,385,036 A 1/1995 Spillane et al.
5,509,157 A 4/1996 Story
5,566,407 A 10/1996 Lien
5,575,025 A 11/1996 Peters
5,577,276 A 11/1996 Nicholson et al.
5,642,543 A 7/1997 Huntley
5,642,545 A 7/1997 Howard
5,699,571 A 12/1997 Yowell
5,706,534 A 1/1998 Sherman
D394,366 S 5/1998 Graebe et al.
D396,981 S 8/1998 Laidlaw
5,787,534 A 8/1998 Hargest et al.
5,806,112 A 9/1998 Harms
5,855,031 A 1/1999 Swift, Jr.
5,857,232 A 1/1999 Mahdavi
5,881,408 A 3/1999 Bashista et al.
5,933,885 A 8/1999 Glassford
5,937,458 A 8/1999 Derosa
6,012,189 A 1/2000 Dudley
6,019,421 A 2/2000 Roh
6,026,330 A 2/2000 Chuang
6,039,393 A 3/2000 Roh
6,055,690 A 5/2000 Koenig
6,089,947 A 7/2000 Green
D433,851 S 11/2000 Roh
6,168,495 B1 1/2001 Yoon
6,170,101 B1 1/2001 McCloud
6,178,573 B1 1/2001 Wagner et al.
6,243,895 B1 6/2001 Amin
6,302,487 B1 10/2001 Fujita et al.
6,315,364 B1 11/2001 Fujita et al.
6,347,422 B2 2/2002 Heavrin
6,421,857 B2 7/2002 Whatman et al.
6,438,775 B1 8/2002 Koenig
6,489,000 B1 12/2002 Ogura et al.
6,550,083 B1 4/2003 Lamantia
6,670,018 B2 12/2003 Fujita et al.
6,701,555 B1 3/2004 Ermini
6,760,935 B1 7/2004 Burton et al.
6,772,457 B1 8/2004 Alaback
6,859,962 B2 3/2005 Diak/Ghanem
6,979,491 B2 12/2005 Yan et al.
6,988,286 B2 1/2006 Schecter et al.
D517,698 S 3/2006 Savage
7,007,325 B1 3/2006 Gomeh
7,055,192 B2 6/2006 Waters et al.
D532,640 S 11/2006 Pressler
7,523,513 B2 4/2009 Waters et al.
8,572,779 B2 11/2013 Pratt et al.
9,265,369 B1 * 2/2016 Beliveau ..... A47G 9/10
2001/0000362 A1 4/2001 Wagner et al.
2002/0034901 A1 3/2002 Fujita et al.
2002/0178500 A1 12/2002 Koenig
2004/0019972 A1 * 2/2004 Schecter ..... A47G 9/10 5/645
2004/0128764 A1 7/2004 McGrath et al.
2004/0199999 A1 10/2004 Landry
2005/0132498 A1 * 6/2005 Vrionis ..... A47C 27/005 5/737
2005/0177942 A1 8/2005 Finn et al.
2005/0217030 A1 10/2005 Seigler
2006/0010608 A1 1/2006 Defranks et al.
2007/0246157 A1 10/2007 Mason
2007/0261173 A1 11/2007 Schlussel
2009/0049870 A1 * 2/2009 Garus ..... D04B 21/16 66/192
2009/0083908 A1 4/2009 Fry
2009/0106904 A1 4/2009 Swarts

FOREIGN PATENT DOCUMENTS

WO 2004056237 A2 7/2004
WO 2009034193 A1 3/2009
WO 2010075294 A1 7/2010
WO WO 2010075294 A1 * 7/2010 ..... A47G 9/10

OTHER PUBLICATIONS

S. Munoz, Shopping Around/Antimicrobial Sheets, Wall Street Journal, Jan. 4, 2007.
Silver used by big business to make antimicrobial clothing, http://www.nanobiosilver.com/applications.html (Jul. 2008).

(56) References Cited

OTHER PUBLICATIONS

C. Gromer, "Smart Threads Today's Technology Driven Fabrics Coddle You While Battling the Elements", Popular Mechanics, pp. 78-81 (Apr. 2004).

* cited by examiner

PILLOW WITH GUSSET AND OPEN CELL CONSTRUCTION

CROSS-REFERENCE TO RELATED APPLICATION

This application claims priority to U.S. Provisional Patent Application No. 61/499,907 filed Jun. 22, 2011, the entire contents of which are incorporated by reference herein.

BACKGROUND OF THE INVENTION

1. Field of the Invention

The present invention relates to upper neck and head support in the form of a pillow for the human body.

2. Description of the Related Art

The use of a pillow made typically of a fabric cover stuffed with a compliant soft material is known in the prior art. Conventional pillows generally provide a soft cushion on which to place the head of an infant, child, or adult while resting or sleeping, either in bed, or on upholstered furniture in which case the pillows typically have a permanent fabric cover. Additionally, positional specific pillows have been heretofore devised and utilized fix the purpose of supporting the head and neck of people.

SUMMARY OF THE INVENTION

A pillow is provided herein which includes a cover having opposing first and second panels. A gusset perimetrically hounds, and joins, the first and second panels. The gusset is formed of an open cell construction. Compliant fill material is disposed within the cover. Advantageously, with the subject invention, a pillow is provided allowing for lateral ventilation between opposing panels. This permits a cooling effect while a user is resting or sleeping.

An "open cell construction" as used herein refers to a construction having overall porosity greater than the inherent porosity of the constituent material or inherently having high porosity.

These and other features of the invention will be better understood through a study of the following detailed description and accompanying drawings.

DETAILED DESCRIPTION OF THE INVENTION

Figure 1:
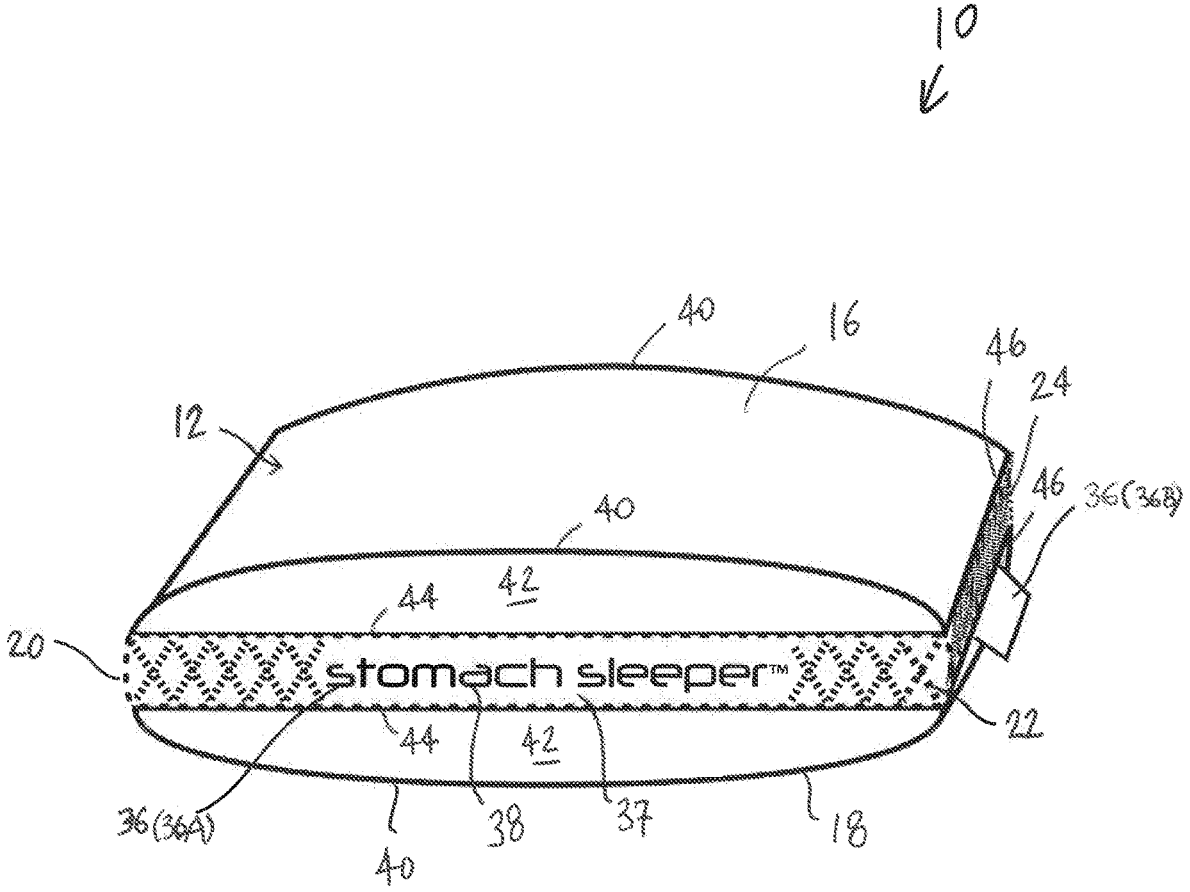
FIG. 1 is a perspective view of a pillow formed in accordance with the subject invention.

With reference to the Figures, a pillow 10 is provided having generally a cover 12 with compliant fill material 14 disposed therein. The cover 12 includes opposing first and second panels 16, 18 and a gusset 20 which perimetrically bounds, and joins, the first and second panels 16, 18, the gusset 20 being formed of an open cell construction. The first and second panels 16, 18 are sized and shaped to accept a user's head to provide support therefor.

The gusset 20 preferably is generally flat. In addition, it is preferred that the gusset 20 have sufficient width to separate the first panel 16 from the second panel 18 so as to define an air flow channel therethrough. This, thus, allows for an open cell construction band to be defined about the pillow 10 between the first and second panels 16, 18. With pressure and/or heat applied to one or both of the first and second panels 16, 18, the gusset 20 provides venting therethrough of the interior of the cover 12. The venting may enhance the comfort of a user. With the first and second panels 16, 18 preferably defining each a generally rectangular footprint common with the gusset 20, the gusset 20 is provided as four contiguous portions, including two longer longitudinal portions 22 joined by two shorter end portions 24.

Figure 3:
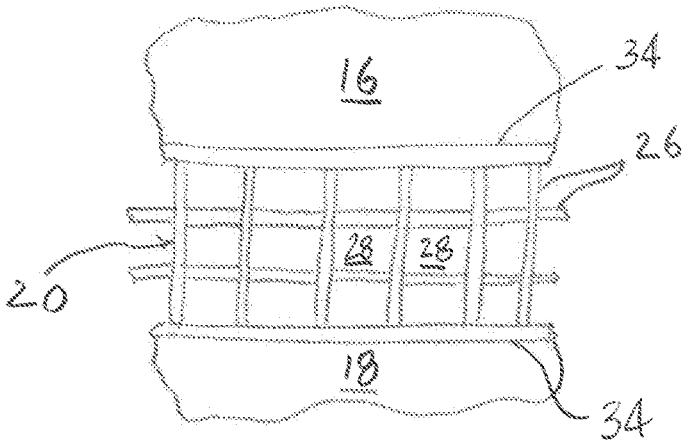
FIGS. 3-5 depict different open cell constructions useable with the subject invention.

The open cell construction of the gusset 20 may be defined by various constructions. With reference to FIG. 3, the gusset 20 may be defined by a plurality of interlaced or spaced-apart strands 26 arranged randomly or in various patterns, such as a pattern (FIG. 1) or a rectangular pattern (FIG. 3). The strands 26 may be of various materials, including, e.g., polyester, and may be elastic or inelastic. The strands 26 are arranged so that open cells 28 are defined therebetween. The strands 26 may be connected at points of intersection (e.g., by fusion, stitching, being tied, by a fastener, and so forth) or may be not connected so as to permit free movement between contacting strands 26. If connected, it is preferred that the strands 26 be formed of elastic material. In addition, the strands 26 may be disposed in multiple layers so as to define a three-dimensional structure in a direction towards the interior of the pillow 10.

Figure 4:
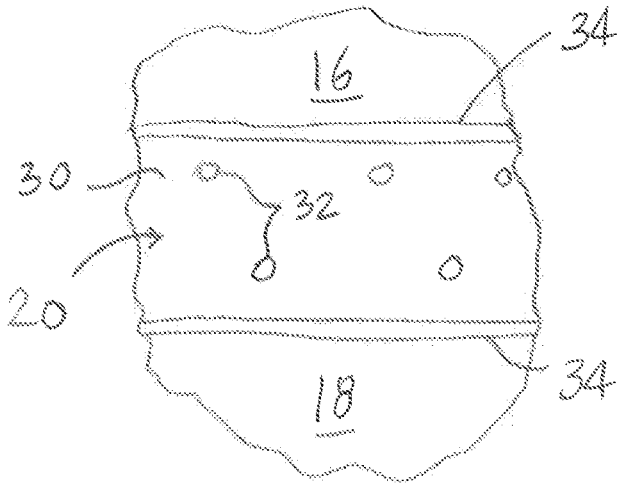

With reference to FIG. 4, the gusset 20 may be formed of a base material 30, which is preferably a textile, such as a polyester textile. Apertures 32 may be defined in the base material 30 with the apertures 32 defining the open cells of the gusset 20. The apertures 32 are larger in size than any pores that may be inherently defined in the base material 30. The apertures 32 may be formed during manufacture of the base material 32 or formed after manufacture, such as by cutting, or material removal from, the base material 30. The apertures 32 may be unfinished or finished, such as with trim or stitching. The base material 30 may be single or multi-ply.

Figure 5:
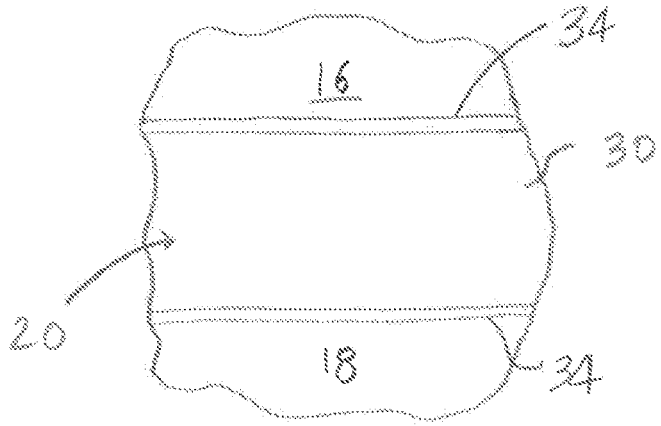

As a further variation, and with reference to FIG. 5, the gusset 20 may be formed with the base material 30 being inherently significantly porous. Preferably, the base material 30 is formed of 3D spacer fabric, which is inherently highly porous. More preferably, the base material 30 is formed of polyester 3D spacer fabric. The pores of the base material 30 may be formed with irregular or regular shapes, such as circle-like or polygon-like shapes (e.g., diamond-like shapes). The porosity of the base material 30 may be substantially greater than the porosity of the material forming the first panel 16 and/or substantially greater than the porosity of the material forming the second panel 18. "Substantially greater" refers to being at least greater than, but preferably being at least twice greater than. The base material 30 may be single or multi-ply. If multi-ply, the collective porosity of the base material 30, through all layers. is considered as being substantially greater than the porosity of the material of either the first panel 16 or the second panel 18.

The gusset 20 may include one or more of the open cell configurations described above in connection with FIGS. 3-5 singularly or in any combination.

The gusset 20 may be joined to the first and second panels 16, 18 using any conventional technique, including being sewn together. To provide the pillow 10 with a robust construction, it is preferred that piping 34, or other reinforcing material and/or stitching, be provided at the points of connection between the gusset 20 and each of the first and second panels 16, 18.

One or more labels 36 may be provided with the pillow 10 to indicate the intended use of the pillow 10, and/or to provide additional or explanatory information regarding the pillow 10. For example, with reference to FIG. 1, the label 36 may be in the form of banner 36A which may be a strip of textile, e.g., satin, having indicia 38 thereon, e.g. by embroidery, with the banner 36A being secured to a portion of the pillow 10. Preferably, the banner 36A with the indicia 38 thereon is located over a portion of the gusset 20. The banner 36A is preferably attached along one of its faces so as to have one face 37 exposed with the indicia 38 thereon. This allows for easy visual recognition of information related to the pillow 10, such as an intended purpose of the pillow, even with a plurality of the pillows 10 being stacked. The label 36 may be also in the form of tag 36B which may be in the form of one or more individual pieces of sheet material (e.g., paper and/or textile) which is affixed to the pillow 10 in any known technique, such as by sewing, gluing, mechanically fastening, and so forth. The tag 36B may include printed, or otherwise provided thereon, information, such as care and/or allergy information. The tag 36B may be secured at a seam in the cover 12, such as along the connection between one of the first and second panels 16, 18 and the gusset 20. The tag 36B is preferably attached along one of its edges so as to have both faces viewable.

The indicia 38, without the banner 36A, may be directly affixed to the pillow 10, such as by embroidery, printing or other marking. For example, the indicia 38 may be directly affixed to the gusset 20, such as by embroidery. With direct application of the indicia 38 to the gusset 20, the ability to pass air through the gusset 20 is minimally impacted.

Different fill materials 14 are possible for the pillow 10. The fill material may be blends of hypoallergenic polyester fibers to achieve different levels of support versus softness as described above. For example, with the pillow 10 being intended for a stomach sleeping position, the pillow 10 may be provided with a fill of microfiber; with the pillow 10 being intended for a back sleeping position, the pillow 10 may be provided with a fill of a blend of conjugate and hollow slick fiber; and, with the pillow 10 being intended for a side sleeping position, the pillow 10 may be provided with a fill of cluster/ball fiber. As will be appreciated by those skilled in the art, other fills are possible. Various down, memory foam (solid layer(s) and/or clusters) and/or latex (solid layer(s) and/or springs), in varying combinations, may be utilized with the pillow 10 herein. The indicia 38 may be provided to indicate the intended sleep position of the pillow 10 based on the fill material therein.

Figure 2:
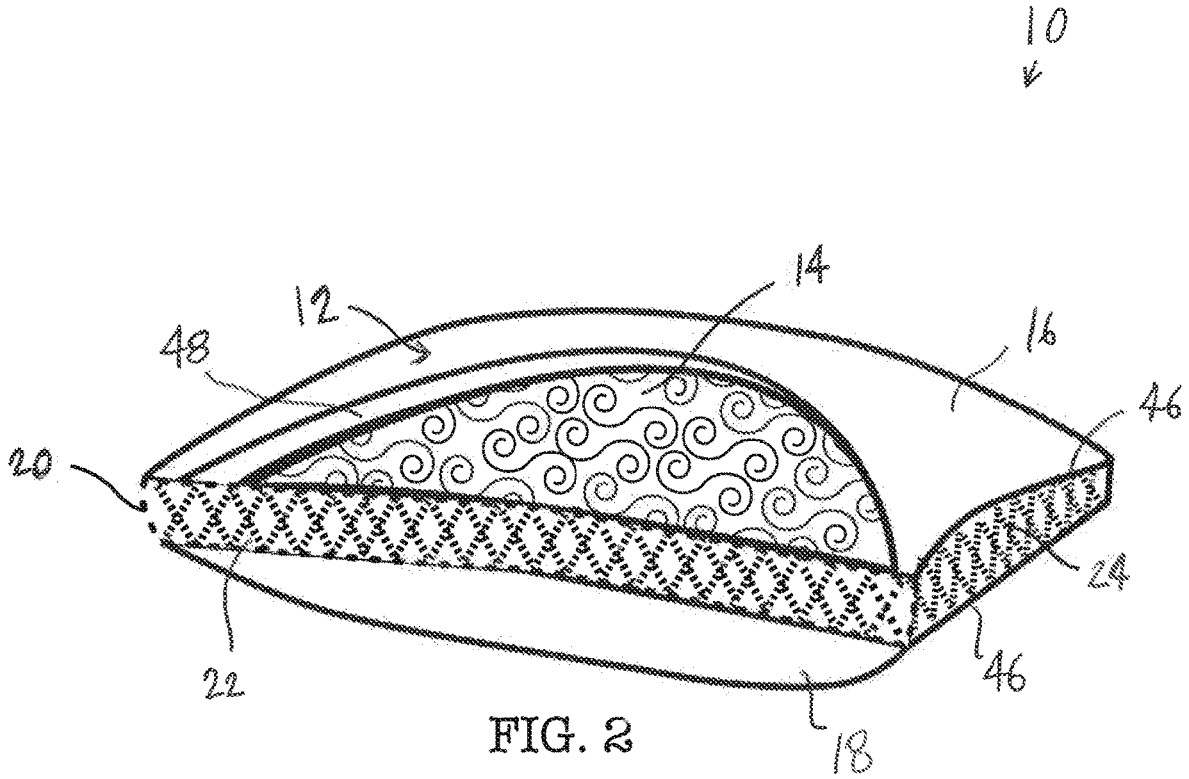
FIG. 2 is a partial cut-away view of the pillow of FIG. 1.

The pillow 10 may be of various configurations. In a preferred embodiment, the pillow 10 is provided with increased height at central portions, as shown in FIGS. 1 and 2. The fill material 14 is configured to provide the desired shape. More preferably, the first and second panels 16, 18 may be arcuately bowed-out in opposing directions (e.g., being convexly arc-shaped in opposing directions). Preferably, top edges 40 of the first and second panels 16, 18 are generally straight and parallel as viewed in a direction perpendicular to the first and second panels 16, 18. The top edges 40 may be parallel to the longitudinal portions 22 of the gusset 20. An area 42 may be defined between and be bounded by the top edge 40 and the longitudinal portion 22 on opposing sides of each of the first and second panels 16, 18. The areas 42 are preferably flat and coplanar with the corresponding top edge 40 and longitudinal portion 22.

The first and second panels 16, 18 each preferably include bottom edges 44, each extending along the bottom of one of the areas 42, and end edges 46. The bottom edges 44 extend between the end edges 46 so as to define a generally rectangular profile. The gusset 20 is preferably attached to the first and second panels 16, 18 along the rectangular profiles of the bottom edges 44/end edges 46 of the first and second panels 16, 18.

The present invention provides the correct alignment to head and neck area for the specific position of the user (back, stomach or side) while at the same time creating an environment of cooling and airflow, which allows the sleeper to maintain their body temperature, and spine alignment, which encourages a normal sleep cycle.

To enhance the cooling effect, it is preferred that an inner cover 48 be provided, located inside the cover 12, in which the fill material 14 is disposed. Preferably, the inner cover 48 is relatively resistant to air flow therethrough, such as being formed by one or more layers of non-woven material (e.g., 100% polyester). The inner cover 48 may be formed of spandex or a spandex blend, such as polyester/spandex; although less resistance to air flow therethrough is provided by spandex or a spandex blend as compared to non-woven material, the spandex or spandex blend provides greater elasticity than the non-woven material which may provide greater comfort to a user. The inner cover 48 acts as a barrier against air floe into the fill material 14. With the gusset 20 being of open cell construction air exchange about the inner cover 48 is permitted. This allows for heat dissipation and minimal heat collection within the pillow 10 in addition, because the inner cover 48 acts as an air barrier during use, heat transfer by air flow into the fill material 14 may be reduced.

The first panel 14 and/or the second panel 18 may be formed of various materials particularly various textiles. Preferably, the first panel 14 and/or the second panel 18 is formed of a moisture-wicking fabric, such as 100% polyester fabric, rayon, nylon, or spandex-blend fabric for increased performance and stretch-ability, which allows for moisture dispersion and, thus, heat management to cool the head and body. A cooling material, such as a gel, may be applied interiorly to the front panel 14 and/or the second panel 18. The cooling material may be silicon or polyether gel formed into layers and applied shapes, as well as, formed ceramics, neoprene and other material technology as developed and available for use to perform heat transfer and temperature regulation function. Depending on the nature and stability of the cooling material, the cooling material may be applied internally and/or externally to the front panel 14 and/or the second panel 18.

In an alternative embodiment, the first panel 14 and/or the second panel 18 may be partially or wholly formed with open cell construction. Any of the open cell constructions discussed above may be utilized. The first panel 14, the second panel 18 and/or the gusset 20 may use the same or different open cell configurations in various combinations. The first panel 14, the second panel 18 and/or the gusset 20 may be provided with different visual appearances (e.g., different colors, patterns, etc.) in various combinations.

Figure 6:
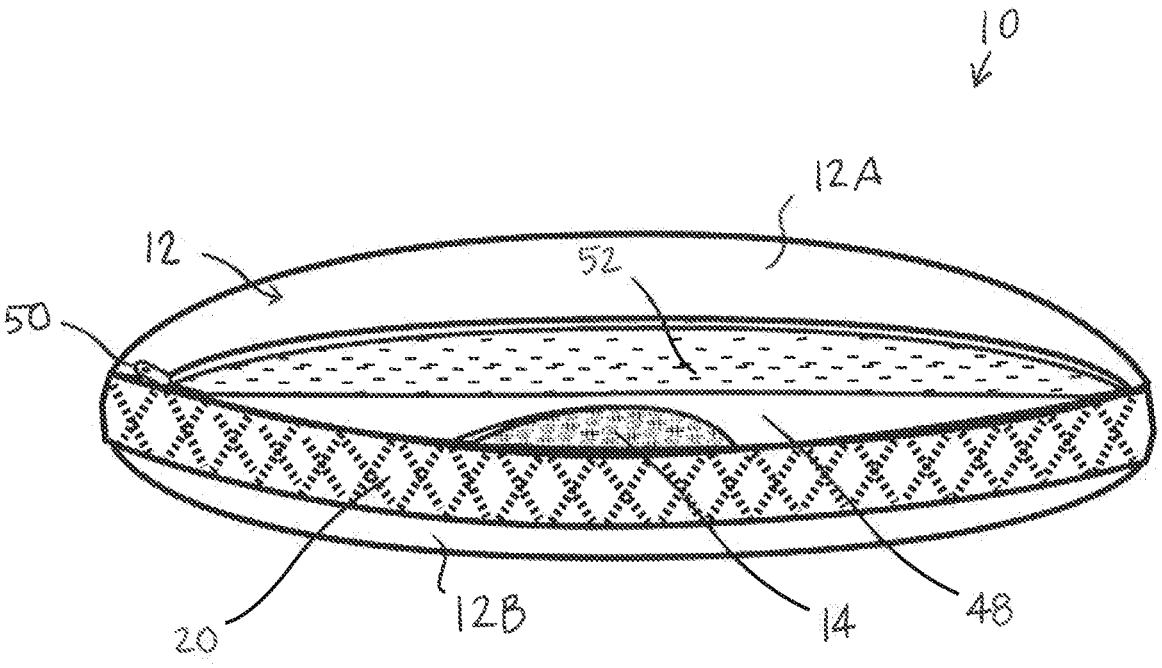
FIG. 6 is a perspective view of a pillow formed in accordance with the subject invention have a cover with separable portions; and, FIG. 7 is a perspective view of a foam layer useable with the subject invention.

To allow for washing of the cover 12, the cover 12 may be formed by at least two partially or wholly separable portions 12A, 12B, as shown in FIG. 6. By separating the separable portions 12A, 12B, the cover 12 may be removed from the fill material 14, and the inner cover 48, if used. Preferably, the cover 12 is separated along at least one of the longitudinal portions 22 of the gusset 20 and possibly along portions of one or both of the end portions 24 and/or along the other of the longitudinal portions 22. One or more fasteners 50 may be provided to selectively join the separable portions 12A, 12B. The fastener(s) 50 is preferably a zipper, but may also include buttons, snaps, hook-and-pile fasteners, and an forth.

Figure 7:
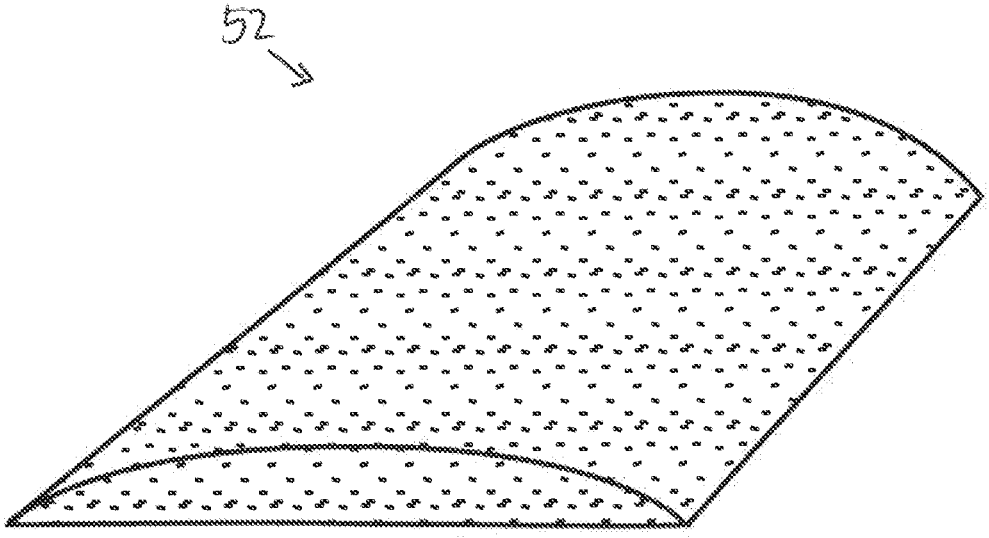

With the inner cover 48 being used, it is preferred that all of the fill material 14 be located therein. In an alternative embodiment, as shown in FIG. 6, a portion of the fill material 14 may be located outside of the inner cover 48 within the cover 12. If a portion of the fill material 14 is located outside of the inner cover 48, it is preferred that the fill material 14 include one or more solid foam layers 52 located between the cover 12 and the inner cover 48. In a preferred arrangement, the same number of similarly configured (shape, material) solid foam layers 52 are located on both sides of the inner cover 48. As shown in FIG. 7, the solid foam layers 52 may be shaped to impart overall shape to the pillow 10. Preferably, the solid foam layers 52 have an arcuate profile to impart an outwardly-bowed shape to the first and second panels 16, 18.

What is claimed is:

1. A pillow comprising:

a cover having opposing first and second panels, the panels each including a planar portion that extends from a first edge to a second edge, the cover including a gusset perimetrically bounding, and joining, the first and second panels, the gusset being sewn together with the panels to permanently join the gusset with the panels, the gusset comprising a top surface that engages the second edge of the first panel and a bottom surface that engages the second edge of the second panel such that the gusset is coplanar with the planar portions, the gusset being formed of a base material, the first and second panels each being less porous than the gusset;

an inner cover disposed within the cover; and a fill material disposed within the inner cover wherein the inner cover acts a barrier against air flow into the fill material.

2. A pillow as recited in claim 1, wherein the base material is a textile.

3. A pillow as recited in claim 1, wherein the base material is a polyester textile.

4. A pillow as recited in claim 1, wherein apertures are defined in the base material.

5. A pillow as recited in claim 4, wherein the apertures are larger in size than any pores inherently defined in the base material.

6. A pillow as recited in claim 4, wherein the apertures are formed by removing material from the base material.

7. A pillow as recited in claim 4, wherein the apertures are unfinished.

8. A pillow as recited in claim 4, wherein the apertures are finished with trim or stitching.

9. A pillow as recited in claim 1, wherein the base material is single-ply.

10. A pillow as recited in claim 1, wherein the base material is multi-ply.

11. A pillow as recited in claim 1, wherein the fill material defines a core having a rectangular footprint that provides the pillow with a rectangular footprint.

12. A pillow as recited in claim 1, wherein the fill material is enclosed within the inner cover.

13. A pillow as recited in claim 1, wherein the base material is 3D spacer fabric.

14. A pillow comprising:

a cover having opposing first and second panels, the panels each including a planar portion that extends from a first edge to an opposite second edge, the cover including a gusset perimetrically bounding, and joining, the first and second panels, the gusset being sewn together with the panels to join the gusset with the panels, the gusset comprising a top surface that engages the second edge of the first panel and a bottom surface that engages the second edge of the second panel such that the gusset is coplanar with the planar portions, the gusset being formed of a base material;

an inner cover disposed within the cover; and a fill material disposed within the inner cover such that the fill material is enclosed within the inner cover, the fill material defining a core having a rectangular footprint that provides the pillow with a rectangular footprint, wherein the first and second panels are each less porous than the gusset, and wherein the inner cover acts a barrier against air flow into the fill material.

15. A pillow as recited in claim 14, wherein the base material is a polyester textile.

16. A pillow as recited in claim 14, wherein apertures are defined in the base material.

17. A pillow as recited in claim 16, wherein the apertures are larger in size than any pores inherently defined in the base material.

18. A pillow as recited in claim 16, wherein the apertures are formed by removing material from the base material.

19. A pillow comprising:

a cover having opposing first and second panels, the panels each including a planar portion that extends from a first edge to an opposite second edge, the cover including a gusset perimetrically bounding, and joining, the first and second panels, the gusset being sewn together with the panels to permanently join the gusset with the panels, the gusset comprising a top surface that engages the second edge of the first panel and a bottom surface that engages the second edge of the second panel such that the gusset is coplanar with the planar portions, the gusset being formed of a base material, the cover including only one pocket between opposite outer surfaces of the panels;

an inner cover disposed within the pocket; and a fill material disposed within the inner cover such that the fill material is enclosed within the inner cover, the fill material being configured to provide the pillow with a rectangular footprint, the fill material consisting of a material selected from a group consisting of memory foam, down, latex, hypoallergenic polyester, microfiber, a blend of conjugate and hollow slick fiber, cluster fiber, and ball fiber, wherein the inner cover consists of polyester such that the inner cover acts a barrier against air flow into the fill material, the gusset being configured to allow air exchange about the inner cover.

20. A pillow as recited in claim 19, wherein apertures are defined in the base material, the apertures being larger in size than any pores inherently defined in the base material, the apertures being formed by removing material from the base material.

* * * * *